US010025238B2

(12) United States Patent
Yokoyama et al.

(10) Patent No.: US 10,025,238 B2
(45) Date of Patent: Jul. 17, 2018

(54) FIXING APPARATUS THAT CONTROLS CURRENT FOR DRIVING AN INDUCTION HEATER

(71) Applicants: KABUSHIKI KAISHA TOSHIBA, Tokyo (JP); TOSHIBA TEC KABUSHIKI KAISHA, Tokyo (JP)

(72) Inventors: Shuji Yokoyama, Sunto Shizuoka (JP); Yuki Kawashima, Tagata Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/339,287

(22) Filed: Oct. 31, 2016

(65) Prior Publication Data

US 2017/0045847 A1 Feb. 16, 2017

Related U.S. Application Data

(63) Continuation of application No. 14/927,207, filed on Oct. 29, 2015, now Pat. No. 9,501,014.

(30) Foreign Application Priority Data

Nov. 27, 2014 (JP) ..... 2014-240105
Jun. 11, 2015 (JP) ..... 2015-118445

(51) Int. Cl.
*G03G 15/20* (2006.01)

(52) U.S. Cl.
CPC ..... *G03G 15/2039* (2013.01); *G03G 15/2053* (2013.01); *G03G 15/2078* (2013.01); *G03G 2215/2016* (2013.01)

(58) Field of Classification Search
CPC ..... G03G 15/2016; G03G 15/2053; G03G 15/2078; G03G 2215/2016
See application file for complete search history.

(56) References Cited

U.S. PATENT DOCUMENTS 4,365,139 A 12/1982 Dannatt
6,021,303 A 2/2000 Terada et al.
(Continued)

FOREIGN PATENT DOCUMENTS

JP 2001-267050 9/2001
JP 2004-361796 12/2004

OTHER PUBLICATIONS

U.S. Appl. No. 14/694,063, filed Apr. 23, 2015.

*Primary Examiner* — David Bolduc
(74) *Attorney, Agent, or Firm* — Patterson & Sheridan, LLP

(57) ABSTRACT

A fixing apparatus includes a belt including a ferromagnetic layer. A ferromagnetic plate is disposed inside the belt and has a Curie point that is lower than a Curie point of the ferromagnetic layer. An induction heater causes heat generation in the ferromagnetic layer and the ferromagnetic plate. The induction heater includes a coil. A driving circuit outputs a high frequency current to the coil, and changes the high frequency current. A temperature sensor measures a temperature of the coil. A controller controls the driving circuit to decrease the high frequency current if the temperature of the coil measured by the temperature sensor is higher than a predetermined value.

10 Claims, 9 Drawing Sheets

(56) References Cited

U.S. PATENT DOCUMENTS

| | | | | |
|---|---|---|---|---|
| 6,188,054 | B1 * | 2/2001 | Ohta | G03G 15/2053 219/619 |
| 6,252,212 | B1 * | 6/2001 | Takagi | G03G 15/2053 219/619 |
| 6,255,633 | B1 * | 7/2001 | Takagi | G03G 15/2053 219/619 |
| 8,855,540 | B2 | 10/2014 | Kikuchi et al. | |
| 2002/0030050 | A1 * | 3/2002 | Takagi | G03G 15/2053 219/619 |
| 2005/0173416 | A1 | 8/2005 | Fukushi et al. | |
| 2005/0286938 | A1 | 12/2005 | Aze et al. | |
| 2006/0216079 | A1 | 9/2006 | Nanjo | |
| 2007/0041757 | A1 | 2/2007 | Tajima et al. | |
| 2007/0127958 | A1 | 6/2007 | Matsuura et al. | |
| 2007/0212091 | A1 | 9/2007 | Kinouchi et al. | |
| 2007/0274748 | A1 | 11/2007 | Yoshikawa | |
| 2008/0019742 | A1 | 1/2008 | Ohno | |
| 2008/0226324 | A1 | 9/2008 | Baba et al. | |
| 2009/0238593 | A1 | 9/2009 | Kinouchi et al. | |
| 2009/0290916 | A1 | 11/2009 | Baba | |
| 2009/0317155 | A1 | 12/2009 | Murakami et al. | |
| 2011/0076043 | A1 | 3/2011 | Kikuchi et al. | |
| 2011/0135358 | A1 | 6/2011 | Kikuchi et al. | |
| 2011/0135359 | A1 | 6/2011 | Kikuchi et al. | |
| 2011/0217096 | A1 | 9/2011 | Kikuchi et al. | |
| 2012/0177419 | A1 | 7/2012 | Kikuchi | |
| 2012/0263509 | A1 | 10/2012 | Yokoyama | |
| 2012/0263510 | A1 | 10/2012 | Mita et al. | |
| 2012/0269533 | A1 | 10/2012 | Wakide et al. | |
| 2013/0084112 | A1 | 4/2013 | Sasaki | |
| 2013/0148995 | A1 | 6/2013 | Yoshikawa et al. | |
| 2014/0314456 | A1 | 10/2014 | Kikuchi | |
| 2014/0314457 | A1 | 10/2014 | Kikuchi | |
| 2015/0168888 | A1 | 6/2015 | Kikuchi | |

* cited by examiner

FIXING APPARATUS THAT CONTROLS CURRENT FOR DRIVING AN INDUCTION HEATER

CROSS-REFERENCE TO RELATED APPLICATIONS

This application is a continuation application of U.S. patent application Ser. No. 14/927,207, filed on Oct. 29, 2015, which is based upon and claims the benefit of priorities from Japanese Patent Application No. 2014-240105, filed on Nov. 27, 2014 and Japanese Patent Application No. 2015-118445, filed on Jun. 11, 2015; the entire contents of each of the applications are incorporated herein by reference.

FIELD

Embodiments described herein relate to a fixing apparatus, in particular, a fixing apparatus that controls the current for driving an induction heater.

BACKGROUND

An image forming apparatus such as a Multi-functional Peripheral (hereinafter referred to as "MFP"), a printer, and the like typically includes a fixing apparatus. The fixing apparatus of one type causes heat generation for the fixing by an electromagnetic induction heating unit (hereinafter referred to as an "IH" unit). A fixing apparatus that includes the IH unit includes a fixing belt and an auxiliary heating unit that generate heat. The IH unit is usually configured to maintain its output level to maintain a certain amount of heat generation. For example, when the auxiliary heating unit loses its magnetism as the temperature thereof increases too much, electric resistance of the IH unit decreases. In this case, to maintain the output level, level of a current supplied from a driving circuit to the IH unit is increased. However, this increase of the current level may damage the driving circuit.

DETAILED DESCRIPTION

Figure 1:
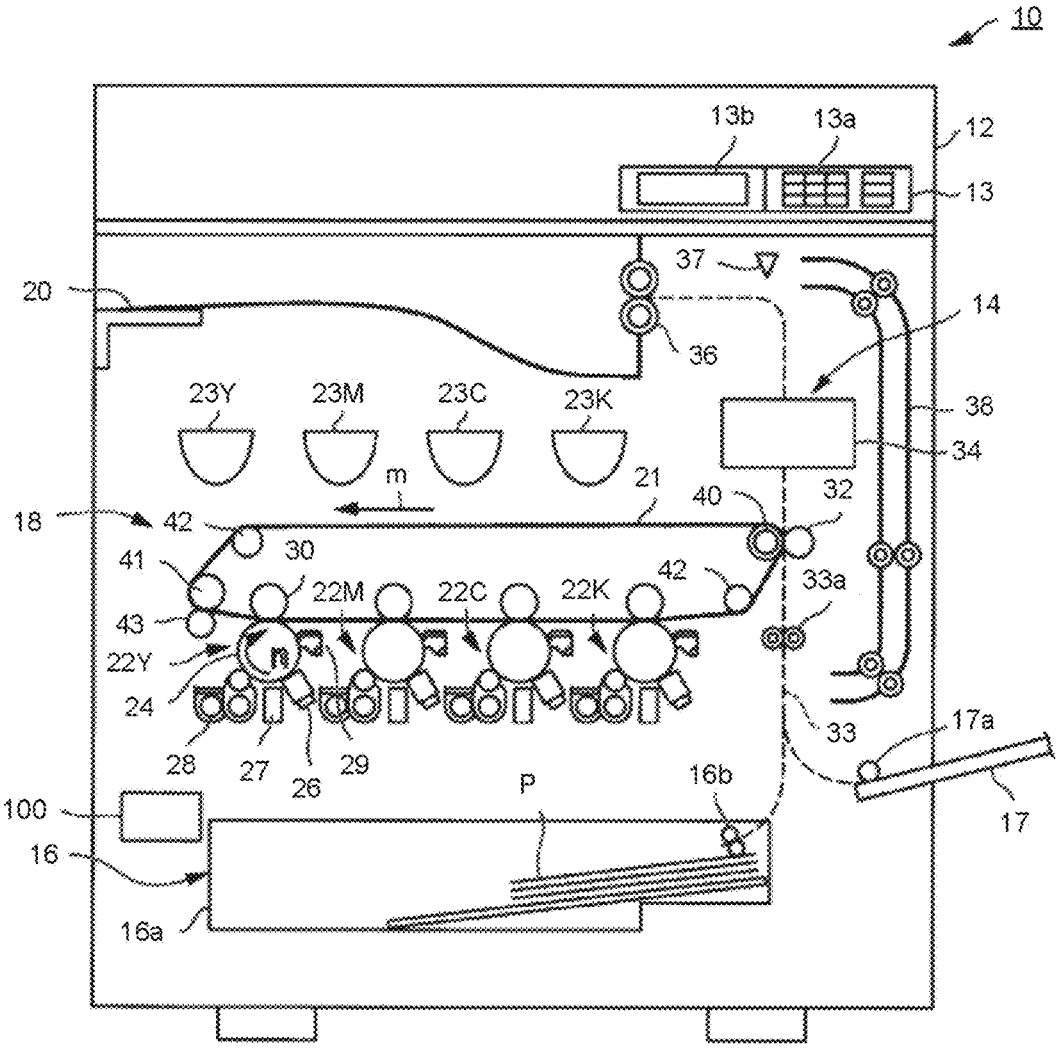
FIG. 1 is a side view of an image forming apparatus according to a first embodiment.

In accordance with an embodiment, a fixing apparatus includes a belt including a ferromagnetic layer, a roller facing the belt, a ferromagnetic plate disposed inside the belt and having a Curie point that is lower than a Curie point of the ferromagnetic layer, an induction heater configured to cause heat generation in the magnetic layer and the ferromagnetic plate, a driving circuit configured to output a high frequency current to the induction heater by switching on and off switching elements thereof, and a controller. An image on a sheet is fixed as the sheet passes through a nip formed between the belt and the roller. The controller is configured to determine whether or not a temperature of the ferromagnetic plate is higher than the Curie point thereof, and control the driving circuit to reduce a level of the high frequency current when the temperature of the ferromagnetic plate is determined to be higher than the Curie point thereof.

First Embodiment

Hereinafter an image forming apparatus 10 according to a first embodiment is described with reference to the accompanying drawings. Further, the same components are applied with same reference numerals in the drawings.

FIG. 1 is a side view of the image forming apparatus 10 according to the first embodiment. A Multi-function peripheral (MFP) is described below as an example of the image forming apparatus 10.

As shown in FIG. 1, the MFP 10 includes a scanner 12, a control panel 13, and a main body section 14. Each of the scanner 12, the control panel 13, and the main body section 14 includes a control section. The MFP 10 includes a system control unit 100 serving as the control section for the scanner 12, the control panel 13 and the main body section 14.

Figure 5:
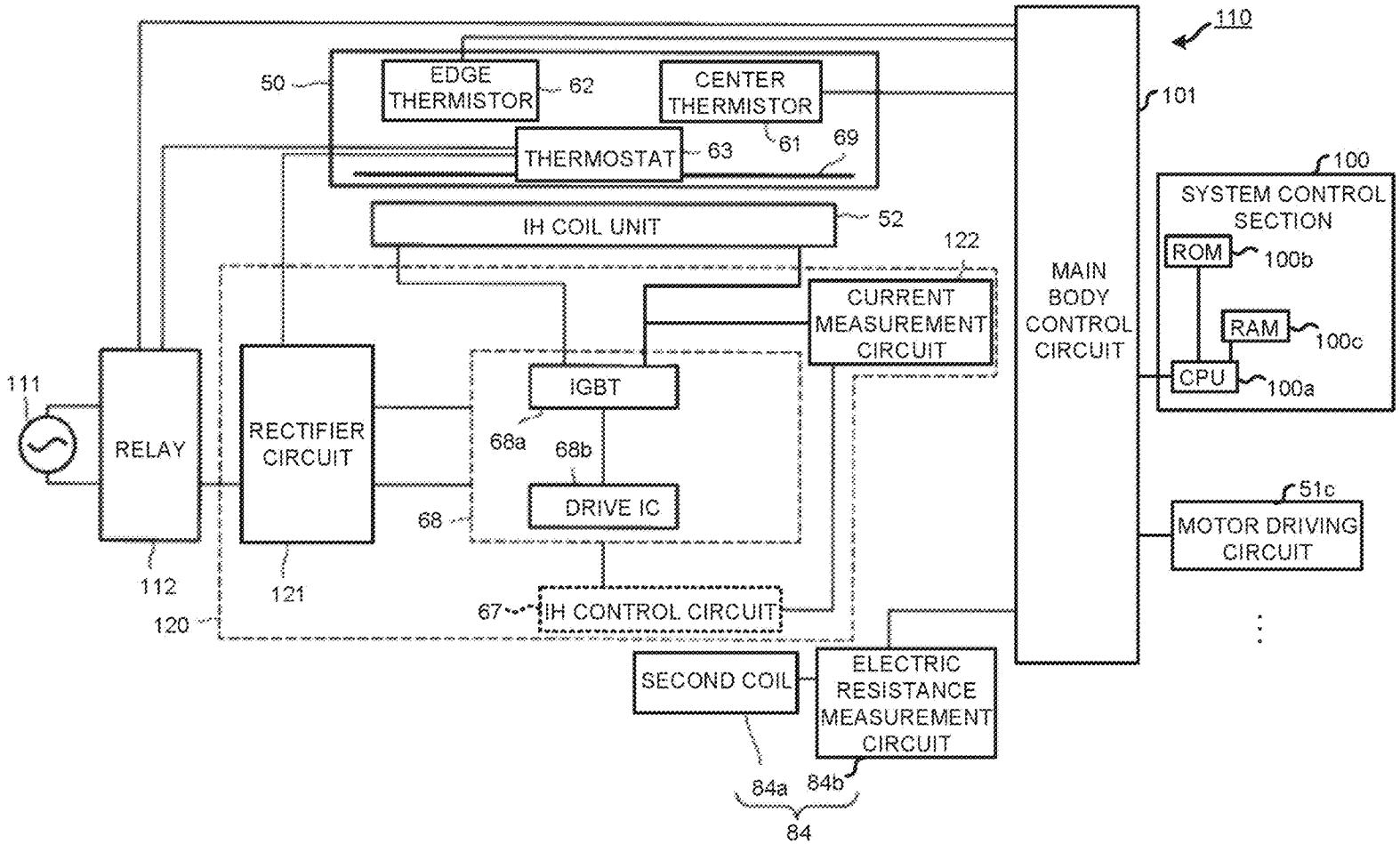
FIG. 5 is a block diagram of a control system, which controls the IH coil unit according to the first embodiment.

The system control unit 100 includes a CPU (Central Processing Unit) 100*a*, an ROM (Read Only Memory) 100*b*, and an RAM (Random Access Memory) 100*c* (refer to FIG. 5). The system control unit 100 controls a main control circuit 101 (refer to FIG. 2) serving as the control section for the main body section 14.

The main control circuit 101 includes a CPU, a ROM and a RAM (none are shown). The main body section 14 includes a paper feed cassette unit 16, a printer unit 18, a fixing apparatus 34, and the like. The main control circuit 101 controls the paper feed cassette unit 16, the printer unit 18, the fixing apparatus 34, and the like.

The scanner 12 reads an image of a document. The control panel 13 has input keys 13*a* and a display unit 13*b*. For example, the input keys 13*a* receive an input from a user. For example, the display unit 13*b* is of a touch panel type. The display unit 13*b* receives an input from the user and displays information to the user.

The paper feed cassette unit 16 includes a paper feed cassette 16*a* and a pickup roller 16*b*. The paper feed cassette 16*a* stores sheets P serving as media. The pickup roller 16*b* picks up the sheet P from the paper feed cassette 16*a*. The paper feed cassette 16*a* is provided to store sheets P. A paper feed tray 17 is provided to feed sheets P with a pickup roller 17*a*.

The printer unit 18 forms an image. For example, the printer unit 18 carries out image forming processing of the image of the document read by the scanner 12. The printer unit 18 includes an intermediate transfer belt 21. In the printer unit 18, the intermediate transfer belt 21 is supported by a backup roller 40, a driven roller 41, and a tension roller 42. The backup roller 40 includes a driving unit (not shown) and configured to rotate on its own. In the printer unit 18, the intermediate transfer belt 21 rotates in a direction indicated by an arrow m.

The printer unit 18 further includes four sets of image forming stations 22Y, 22M, 22C, and 22K. The image forming stations 22Y, 22M, 22C, and 22K are used to respectively form a yellow (Y) image, a magenta (M) image, a cyan (C) image, and a black (K) image. The image forming stations 22Y, 22M, 22C, and 22K are arranged in parallel to each other along the rotational direction of the intermediate transfer belt 21 below the intermediate transfer belt 21.

The printer unit 18 further includes cartridges 23Y, 23M, 23C, and 23K above the image forming stations 22Y, 22M, 22C, and 22K, respectively. The cartridges 23Y, 23M, 23C, and 23K store toner for replenishment of yellow (Y), magenta (M), cyan (C), and black (K), respectively.

Hereinafter, the image forming station 22Y for forming a yellow (Y) image among the image forming stations 22Y, 22M, 22C, and 22K is described as an example. Further, as the configurations of the image forming stations 22M, 22C, and 22K are the same as the configuration of the image forming station 22Y, the detailed description thereof is not provided.

The image forming station 22Y includes a charger 26, an exposure scanning head 27, a developing device 28, and a photoconductive cleaner 29. The charger 26, the exposure scanning head 27, the developing device 28, and the photoconductive cleaner 29 are arranged around a photoconductive drum 24 that is configured to rotate in a direction indicated by an arrow n.

The image forming station 22Y includes a primary transfer roller 30. The primary transfer roller 30 faces the photoconductive drum 24 across the intermediate transfer belt 21.

The image forming station 22Y exposes the photoconductive drum 24 that is charged by the charger 26 through the exposure scanning head 27. The image forming station 22Y forms an electrostatic latent image on the photoconductive drum 24. The developing device 28 develops the electrostatic latent image on the photoconductive drum 24 using a two-component developing agent including toner and carrier.

The primary transfer roller 30 primarily transfers the toner image formed on the photoconductive drum 24 to the intermediate transfer belt 21. The image forming stations 22Y, 22M, 22C, and 22K form a color (full-color) toner image on the intermediate transfer belt 21 through the primary transfer rollers 30. The color toner image is formed by overlapping toner images of Y (yellow), M (magenta), C (cyan), and K (black) in sequence. The photoconductive cleaner 29 removes the toner left on the photoconductive drum 24 after the primary transfer.

The printer unit 18 further includes a secondary transfer roller 32. The secondary transfer roller 32 faces the backup roller 40 across the intermediate transfer belt 21. The secondary transfer roller 32 operates to transfer the color toner image on the intermediate transfer belt 21 to the sheet P. The sheet P is fed by the paper feed cassette unit 16 or the manual paper feeding tray 17 along the conveyance path 33.

The printer unit 18 further includes a belt cleaner 43 facing the driven roller 41 across the intermediate transfer belt 21. The belt cleaner 43 removes toner left on the intermediate transfer belt 21 after the secondary transfer.

The printer unit 18 also includes a register roller 33*a*, a fixing apparatus 34, and a sheet discharge roller 36, along the conveyance path 33. The printer unit 18 further includes a bifurcating unit 37 and a reversal conveyance unit 38 at the downstream side of the fixing apparatus 34 in a sheet conveying direction. The bifurcating unit 37 sends the sheet P subjected to fixing processing to a sheet discharge unit 20 or the reversal conveyance unit 38. In a case of duplex printing, the reversal conveyance unit 38 reverses the sheet P sent from the bifurcating unit 37 to a direction of the register roller 33*a* and conveys the sheet P. The MFP 10 forms a fixed toner image on the sheet P with the printer unit 18 and then discharges it to the sheet discharge unit 20.

Further, the MFP 10 is not limited to the tandem developing system, and the number of the developing devices 28 is also not limited. Further, the MFP 10 may transfer the toner image from the photoconductive drum 24 to the sheet P directly.

Hereinafter, the fixing apparatus 34 is described in detail.

Figure 2:
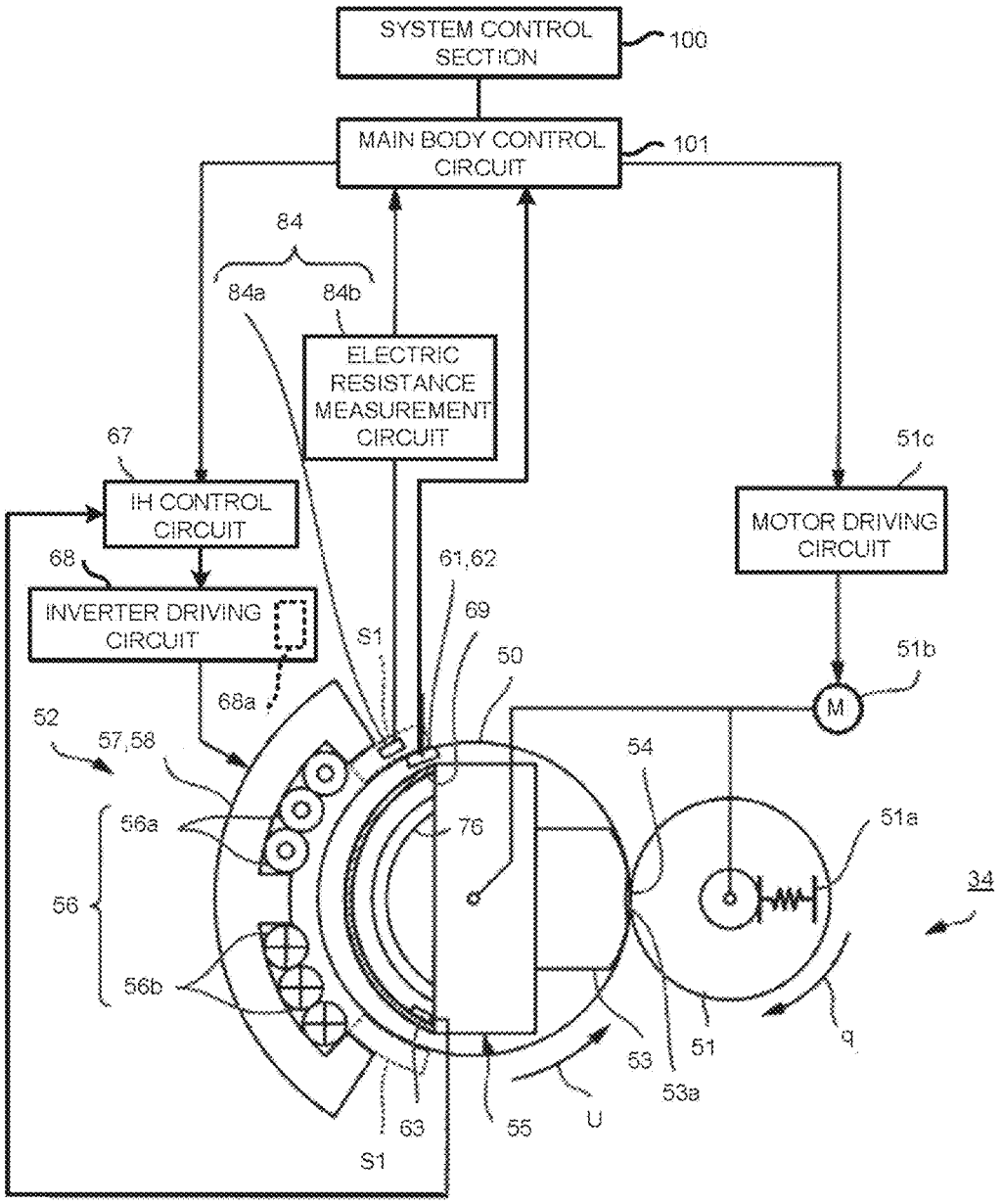
FIG. 2 is a side view of an IH coil unit and illustrates a control block of a main control circuit according to the first embodiment.

FIG. 2 is a side view of the fixing apparatus 34, including an electromagnetic induction heating coil unit 52 (induction current generation section), and illustrates a control block of a main control circuit 101 (control section) according to the first embodiment. Hereinafter, the electromagnetic induction heating coil unit is referred to as an "IH coil unit".

As shown in FIG. 2, the fixing apparatus 34 includes a fixing belt 50, a press roller 51, an IH coil unit 52, an auxiliary heating plate 69 (auxiliary heating section), a second coil unit 84 (measurement section), and the main control circuit 101.

The fixing belt 50 is a cylindrical endless belt. In the inner peripheral space of the fixing belt 50, an internal belt mechanism 55 including a nip pad 53 and the auxiliary heating plate 69 is arranged.

Figure 4:
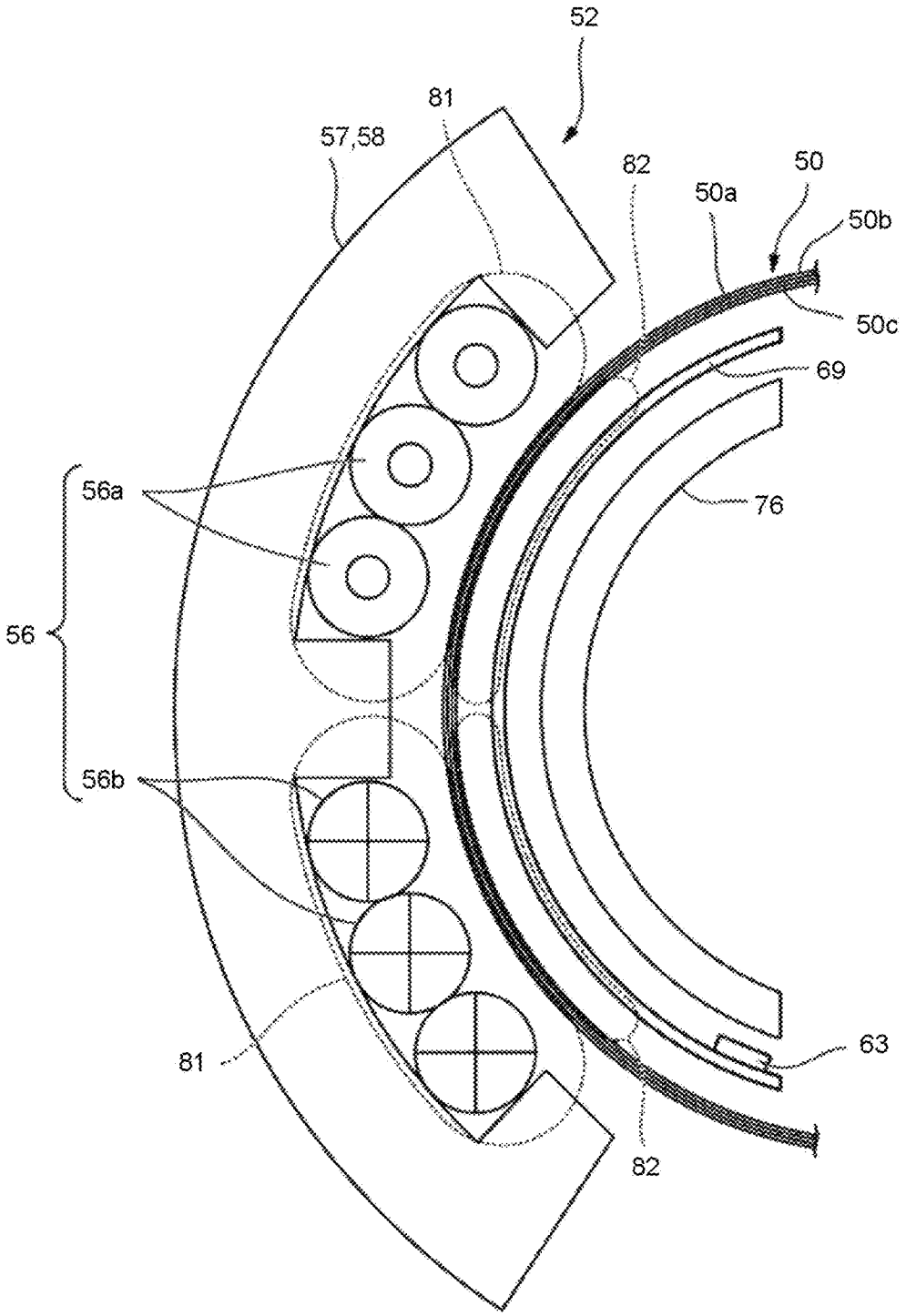
FIG. 4 illustrates magnetic paths of magnetic fluxes extending along a fixing belt and an auxiliary heating plate according to the first embodiment.

The fixing belt 50 is formed by laminating a heating layer 50*a* (conductive layer) serving as a heating unit and a releasing layer 50*c* in sequence on a base layer 50*b* (refer to FIG. 4). Further, as long as the fixing belt 50 includes the heating layer 50*a*, no limitation is given to the layer structure.

The base layer 50*b* is made from, for example, polyimide resin (PI). The heating layer 50*a* is formed of, for example, a non-magnetic metal such as copper (Cu). The releasing layer 50*c* is made from, for example, fluorine resin such as PFA (Tetrafluoroethylene Perfluoro alkyl vinyl ether copolymer resin).

In order to rapidly warm up the fixing belt 50, the heating layer 50*a* is thin and the heat capacity of the fixing belt 50 is low. The fixing belt 50 having low heat capacity shortens the time required to warm up the fixing belt 50 and saves energy consumption for the warming-up.

In order to reduce the heat capacity of the fixing belt 50, the thickness of the copper layer of the heating layer 50*a* is, for example, 10 μm. Further, the heating layer 50*a* is coated by a protective layer such as nickel. The nickel protective layer can suppress the oxidation of copper layer, which can improve the mechanical strength of the fixing belt 50.

Further, the heating layer 50*a* may be formed by performing copper plating as well as electroless nickel plating on the base layer 50*b* made from polyimide resin. By performing the electroless nickel plating, the adhesion strength of the base layer 50*b* to the heating layer 50*a* is improved, and the mechanical strength of the fixing belt 50 is also improved.

Further, the surface of the base layer 50*b* may be roughened through sandblast or chemical etching. By roughening the surface of the base layer 50*b*, the adhesion strength of the base layer 50*b* to the nickel plating of the heating layer 50*a* is further improved.

Further, a metal such as titanium (Ti) may be dispersed into the polyimide resin for forming the base layer 50*b*. By dispersing metal into the base layer 50*b*, the adhesion strength of the base layer 50*b* to the nickel plating of the heating layer 50*a* is further improved.

For example, the heating layer 50*a* may be made from nickel, iron (Fe), stainless steel, aluminum (Al), silver (Ag), or the like. The heating layer 50*a* may use two or more kinds of alloys, and may also be formed by stacking two or more kinds of metal in layer.

Figure 3:
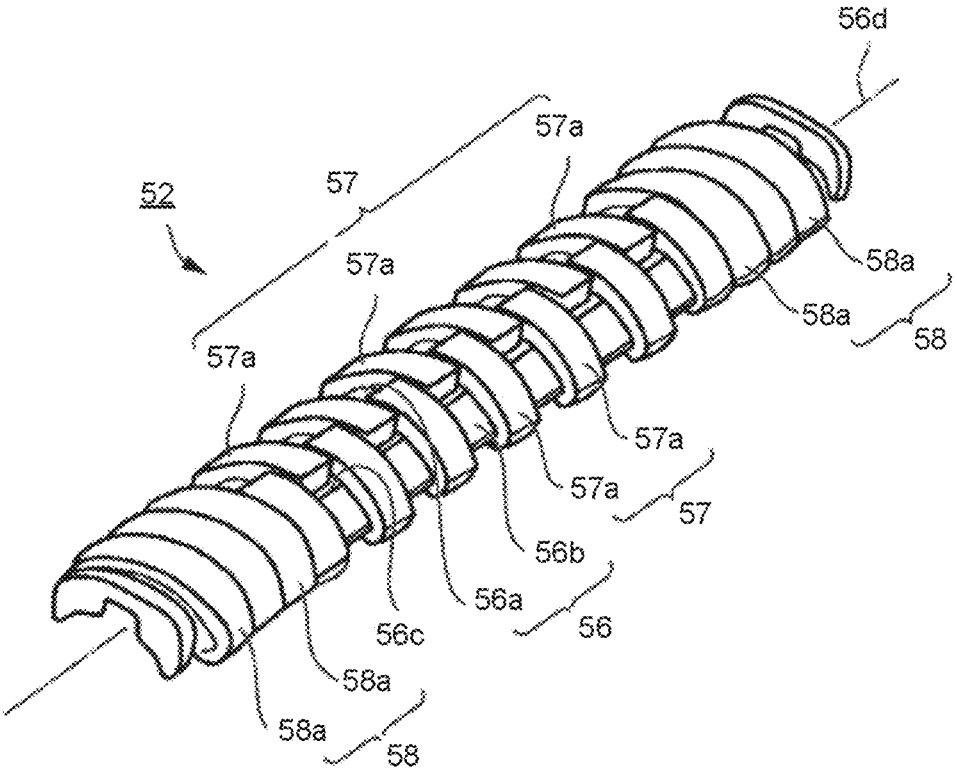
FIG. 3 is a perspective view of the IH coil unit according to the first embodiment.

FIG. 3 is a perspective view of the IH coil unit 52 according to the first embodiment.

As shown in FIG. 3, the IH coil unit 52 includes a main coil 56 (first coil), a first core 57, and a second core 58.

The main coil 56 generates magnetic flux in accordance with application of a high frequency current. The main coil 56 is arranged at the outer peripheral side of the fixing belt 50. The main coil 56 faces the fixing belt 50 in the thickness direction. The longitudinal direction of the main coil 56 is parallel to the width direction of the fixing belt 50 (hereinafter referred to as a "belt width direction").

The first core 57 and the second core 58 cover a side of the main coil 56 (hereinafter referred to as "backside") that is opposite to the side that faces the fixing belt 50. The first core 57 and the second core 58 prevent leakage of the magnetic flux generated by the main coil 56 at the back side. The first core 57 and the second core 58 concentrate the magnetic flux from the main coil 56 on the fixing belt 50.

The first core 57 includes a plurality of single wing parts 57*a*. The plurality of single wing parts 57*a* is alternately arranged in a staggered manner with a center line 56*d* along the longitudinal direction of the main coil 56 as an axis of symmetry.

The second core 58 is arranged at both sides of the first core 57 in the longitudinal direction thereof. The second core 58 includes a plurality of dual wing parts 58*a* across both sides of the main coil 56. For example, the single wing part 57*a* and the dual wing part 58*a* may be made from magnetic material such as a nickel-zinc alloy (Ni—Zn), a manganese-nickel alloy (Mn—Ni), and the like.

The first core 57 regulates the magnetic flux generated by the main coil 56 with the plurality of the single wing parts 57*a*. The magnetic flux generated by the main coil 56 may be regulated alternately by every single wing part 57*a* with a central line 56*d* as an axis of symmetry. The first core 57 concentrates the magnetic flux from the main coil 56 on the fixing belt 50 with the plurality of single wing parts 57*a*.

The second core 58 regulates the magnetic flux generated by the main coil 56 with the plurality of dual wing parts 58*a*. The magnetic flux generated by the main coil 56 is regulated by the dual wing parts 58*a* at both sides of the first core 57. The second core 58 concentrates the magnetic flux from the main coil 56 on the fixing belt 50 with the plurality of dual wing parts 58*a*. The magnetic flux concentration caused by the second core 58 is greater than the magnetic flux concentration caused by the first core 57.

The main coil 56 includes first wings 56*a* and second wings 56*b*. The first wings 56*a* are arranged at one side of the central line 56*d*. The second wings 56*b* are arranged at the other side of the central line 56*d*. Window parts 56*c* are formed between the first wings 56*a* and the second wings 56*b* at the inner side in the longitudinal direction of the main coil 56.

For example, the main coil 56 uses litz wire. The litz wire is formed of a plurality of bundles of copper wire material that is coated by the heat-resistant polyamide-imide serving as an insulated material. The main coil 56 is formed by winding the conductive coils.

As shown in FIG. 2, the main coil 56 generates the magnetic flux through the application of the high frequency current from the inverter driving circuit 68. For example, the inverter driving circuit 68 includes switching elements including the IGBT (Insulated Gate Bipolar Transistor) element 68*a*, a MOSFET (Metal Oxide semiconductor field effect Transistor) element (not shown), and the like. The IGBT element 68*a* is connected to the MOSFET element. By alternately turning on/off the IGBT element 68*a* and the MOSFET element, a high frequency current flows into the main coil 56. By the flow of the high frequency current into the main coil 56, a high frequency magnetic field is generated around the main coil 56. Through the magnetic flux of the high frequency magnetic field, an eddy current is generated in the heating layer 50*a* of the fixing belt 50. Further, Joule heat is generated due to the eddy current flowing in the heating layer 50*a* that has electric resistance. As a result, the fixing belt 50 is heated.

For example, it is assumed that the "ON" period of the IGBT element 68*a* is constant. By varying the "ON" period of the MOSFET element, the high frequency current flowing into the main coil 56 changes. With the change of high frequency current flowing into the main coil 56, the output of the electromagnetic induction heating also changes.

The auxiliary heating plate 69 is arranged at the inner peripheral side of the fixing belt 50. Seen in a belt width direction, the auxiliary heating plate 69 has an arc shape and is arranged along the inner peripheral surface of the fixing belt 50. The auxiliary heating plate 69 faces the main coil 56 across the fixing belt 50. The auxiliary heating plate 69 is formed of a magnetic material (ferromagnetic material) of which the Curie point is lower than that of the heating layer 50*a*. Magnetic flux through the auxiliary heating plate 69 and the fixing belt 50 is generated by the magnetic flux generated by the main coil 56. Consequently, Joule heat is generated in the heating layer 50*a*. The generated Joule heat is used to further heat the fixing belt 50 by the main coil 56.

The auxiliary heating plate 69 is supported by sills (not shown) at the arc-shaped both ends thereof. The outer surface of the auxiliary heating plate 69 in the diameter direction (radial direction) is separated from the inner peripheral surface of the fixing belt 50. For example, the length of a gap between the outer surface of the auxiliary heating plate 69 and the inner peripheral surface of the fixing belt 50 is about 1~2 mm. Alternatively, the outer surface of the auxiliary heating plate 69 may be in contact with the inner peripheral surface of the fixing belt 50.

For example, the auxiliary heating plate 69 in the belt width direction is longer than a sheet-passing area in the belt width direction (hereinafter referred to as a "sheet width"). In addition, the sheet width is a width of a sheet of which the short-side width is longest among sheets that can be used in the MFP 10. For example, it is assumed that the sheet width is a little longer than the short-side width of A3-sized paper.

FIG. 4 illustrates magnetic paths of the magnetic flux generated by the main coil 56 according to the first embodiment. The magnetic paths extend through the fixing belt 50 and/or the auxiliary heating plate 69.

As shown in FIG. 4, the magnetic flux generated by the main coil 56 forms a first magnetic path 81 extending through the heating layer 50*a* of the fixing belt 50. The first magnetic path 81 is formed in such a manner that the first wings 56*a* and the second wings 56*b* of the main coil 56 are surrounded. The first magnetic path 81 passes through the first core 57, the second core 58, and the heating layer 50*a*. Further, the magnetic flux generated by the main coil 56 forms a second magnetic path 82 that extends through the auxiliary heating plate 69. The second magnetic path 82 is formed at a position adjacent to the first magnetic path 81 in a diameter direction of the fixing belt 50 (hereinafter referred to as a "belt diameter direction"). The second magnetic path 82 passes through the auxiliary heating plate 69 and the heating layer 50*a*.

The auxiliary heating plate 69 is formed of thin metal member made from the magnetic shunt alloy such as iron or nickel alloy of which the Curie point is 220~230 degrees centigrade. When the temperature of the auxiliary heating plate 69 exceeds the Curie point thereof, the auxiliary heating plate 69 will lose its magnetism. Specifically, when the Curie point is exceeded, the magnetism of the auxiliary heating plate 69 is changed from ferromagnetism to paramagnetism. When the temperature of the auxiliary heating plate 69 exceeds the Curie point thereof, the second magnetic path 82 is not formed and consequently there is no assistance to the heat of the fixing belt 50. By forming the auxiliary heating plate 69 with the magnetic shunt alloy, the auxiliary heating plate 69 can be used to assist the rise of temperature of the fixing belt 50 when the temperature is lower than the Curie point thereof, and can be used to prevent the excessive temperature rise of the fixing belt 50 when the temperature is higher than the Curie point thereof.

Herein, the heating of the fixing belt 50 is adjusted through electric control of an IH control circuit 67. To keep the belt temperature constant, the output of the IH coil unit 52 is controlled to be constant. If the auxiliary heating plate 69 is formed of magnetic shunt alloy, the auxiliary heating plate 69 loses its magnetism when the temperature thereof exceeds the Curie point, and the second magnetic path 82 is not formed. Consequently, the load (electric resistance) of the IH coil unit 52 decreases.

The IH control circuit 67 increases the current flowing through the inverter driving circuit 68 corresponding to the reduction of load of the IH coil unit 52 so as to keep the output of the IH coil unit 52 constant. If the current flowing through the inverter driving circuit 68 is increased, the current flowing in the IGBT element 68*a* is also increased. If so, the temperature of the IGBT element 68*a* rises excessively, and the IGBT element 68*a* may be damaged. To prevent this, in the present embodiment, the change of magnetism of the auxiliary heating plate 69 is estimated by measuring the electric resistance of the second coil 84*a*. In addition, the IH control circuit 67 controls the IH coil unit 52 to reduce the output of the electromagnetic induction heating when the measured electric resistance is smaller than a threshold value.

Further, the auxiliary heating plate 69 may be formed of a thin metal member having magnetic characteristic such as iron, nickel, stainless steel, and the like. As long as the material has magnetic characteristic, the auxiliary heating plate 69 may be formed of resin including magnetic powder. Alternatively, the auxiliary heating plate 69 may be formed of the magnetic material, ferrite. The magnetic material, ferrite, promotes the heating of the fixing belt 50 through the magnetic flux generated by the induction current. The magnetic material, ferrite, itself does not generate heat even if the magnetic flux generated by induction current passes through it. The auxiliary heating plate 69 is not limited to a thin plate member.

As shown in FIG. 2, a shield 76 is arranged on the inner peripheral side of the auxiliary heating plate 69. The shield 76 has an arc shape similar to the shape of the auxiliary heating plate 69. The shield 76 is supported by sills (not shown) at the arc-shaped ends thereof. Further, the shield 76 may support the auxiliary heating plate 69. For example, the shield 76 is made from non-magnetic material such as aluminum, copper, and the like. The shield 76 shields the magnetic flux from the IH coil unit 52. The shield 76 suppresses an influence on a voltage and the like measured by a thermistor by the magnetic flux.

A nip pad 53 is a pressing unit positioned to press the inner peripheral surface of the fixing belt 50 against the side of the press roller 51. A nip 54 is formed between the fixing belt 50 and the press roller 51. The nip pad 53 has a nip forming surface 53*a*, and the nip 54 is formed between the fixing belt 50 pressed by the nip pad 53 and the press roller 51. Seen in the belt width direction, the nip forming surface 53*a* is curved towards the inner peripheral side of the fixing belt 50 along the outer peripheral surface of the press roller 51.

For example, the press roller 51 includes a heat-resistant silicon sponge layer and a silicon rubber layer around the core bar. For example, a releasing layer is arranged on the surface of the press roller 51. The releasing layer is made from fluorine resin such as the PFA resin and the like. The press roller 51 presses the fixing belt 50 through a pressing mechanism. The press roller 51 and the nip pad 53 serve as a pressing unit which presses the fixing belt 50.

A motor 51*b* is arranged as a driving unit of the fixing belt 50 and the press roller 51. The motor 51*b* is energized by a motor driving circuit 51*c* that is controlled by the main control circuit 101. The motor 51*b* is connected to the press roller 51 through a first gear train (not shown). The motor 51*b* is connected to a belt driving member through a second gear train and a one-way clutch (none is shown). The motor 51*b* causes the press roller 51 to rotate in a direction indicated by an arrow q. When the fixing belt 50 is in contact with the press roller 51, the fixing belt 50 is rotated by the press roller 51 in a direction indicated by an arrow u. When the fixing belt 50 is separated from the press roller 51, the motor 51*b* directly controls the fixing belt 50 to rotate in the direction indicated by the arrow u. The fixing belt 50 may include a driving unit separately from the driving unit of the press roller 51.

A center thermistor 61 and an edge thermistor 62 measure a belt temperature. The measured results of the belt temperature are input to the main control circuit 101. The center thermistor 61 is arranged at a center of the IH coil unit 52 in the belt width direction. The edge thermistor 62 is arranged in a non-paper passing, heating area of the IH coil unit 52 in the belt width direction. The main control circuit 101 controls the IH coil unit 52 in such a manner that the electromagnetic induction heating is stopped when the belt temperature measured by the edge thermistor 62 is greater than a threshold value. The electromagnetic induction heating is stopped when the temperature of the non-paper passing, heating area of the fixing belt 50 rises excessively, and thereby preventing the fixing belt 50 from being damaged.

The main control circuit 101 controls the IH control circuit 67 according to the measured results of the belt temperature by the center thermistor 61 and the edge thermistor 62. The IH control circuit 67 controls the magnitude of the high frequency current output by the inverter driving circuit 68 under the control of the main control circuit 101. The fixing belt 50 is maintained within control temperature ranges in accordance with the output of the inverter driving circuit 68. The IH control circuit 67 includes a CPU, a ROM, and a RAM (none are shown).

A thermostat 63 functions as a safety device of the fixing apparatus 34. The thermostat 63 is operated when the fixing belt 50 generates heat abnormally and the temperature thereof rises to its shut-off threshold value. With the operation of the thermostat 63, the current flowing to the IH coil unit 52 is shut off. In this way, the MFP 10 stops driving, and thereby preventing the fixing apparatus 34 from being abnormally heated.

Hereinafter, a control system 110 of the IH coil unit 52 which enables the fixing belt 50 to generate heat is described in detail.

FIG. 5 is a block diagram of the control system 110 which mainly controls the IH coil unit 52 according to the first embodiment.

As shown in FIG. 5, the control system 110 includes a system control unit 100, the main control circuit 101, an IH circuit 120, and the motor driving circuit 51*c*.

The control system 110 supplies power to the IH coil unit 52 through the IH circuit 120. The IH circuit 120 includes a rectifier circuit 121, the IH control circuit 67, the inverter driving circuit 68, and a current measurement circuit 122.

Current is supplied from an AC power supply 111 to the IH circuit 120 through a relay 112. The IH circuit 120 rectifies the current with the rectifier circuit 121 and then supplies the current to the inverter driving circuit 68. When the thermostat 63 is cut off, the relay 112 shuts off the current from the AC power supply 111. The inverter driving circuit 68 includes a drive IC 68*b* of the IGBT element 68*a*. The IH control circuit 67 controls the drive IC 68*b* according to the measured results of the belt temperature by the center thermistor 61 and the edge thermistor 62. The IH control circuit 67 controls the drive IC 68*b* to control the output of the IGBT element 68*a*. The current measurement circuit 122 sends the measured results output by the IGBT element 68*a* to the IH control circuit 67. The IH control circuit 67 controls the drive IC 68*b* based on the measured results output from the current measurement circuit 122, so that the output of the IH coil unit 52 is constant.

The main control circuit 101 acquires a measurement value R (refer to FIG. 7) from an electric resistance measurement circuit 84*b*. The main control circuit 101 controls the IH coil unit 52 based on the measurement value R. Specifically, the main control circuit 101 determines whether or not the measurement value R is smaller than a threshold value Rt. Then, the main control circuit 101 controls either the continuous driving of the fixing apparatus 34 and the reduction of the output of the IH coil unit 52 based on the determination results. Here, the reduction of output of the IH coil unit 52 includes the stopping of the IH coil unit 52.

Figure 6:
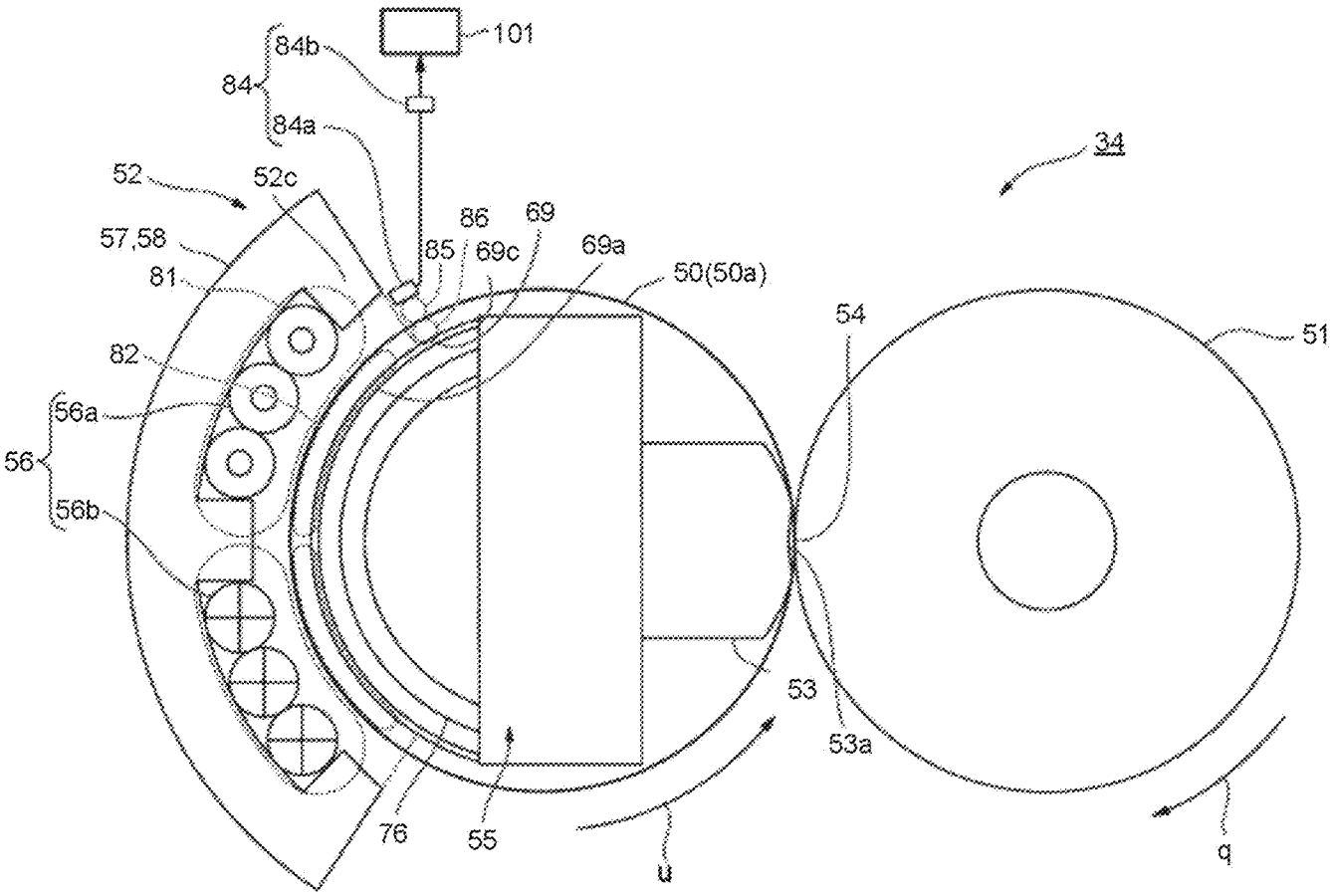
FIG. 6 is a side view of a fixing apparatus according to the first embodiment.

FIG. 6 is a side view of the main portions of the fixing apparatus 34 according to the first embodiment.

As shown in FIG. 6, the second coil unit 84 includes a second coil 84*a* and the electric resistance measurement circuit 84*b* (electric resistance measurement section). The second coil unit 84 measures whether or not the temperature of the auxiliary heating plate 69 exceeds the Curie point thereof. The second coil 84*a* is arranged separately from the main coil 56. The second coil 84*a* generates a magnetic field passing through the auxiliary heating plate 69 through energization. For example, the second coil 84*a* includes winding wire of litz wire. The electric resistance measurement circuit 84*b* measures the electric resistance of the second coil 84*a*. The measured result of the electric resistance of the second coil 84*a* is input to the main control circuit 101.

Hereinafter, it is assumed that an area of the auxiliary heating plate 69 that faces the IH coil unit 52 across the fixing belt 50 and extends along a circumferential direction of the fixing belt 50 (hereinafter referred to as a "belt circumferential direction") is a facing area 69*a*. Further, it is assumed that an end portion 69*c* of the auxiliary heating plate 69 is an end portion of the auxiliary heating plate 69 in the belt circumferential direction, and is an area adjacent to the facing area 69*a*. The end portion 69*c* of the auxiliary heating plate 69 does not face the IH coil unit 52 across the fixing belt 50 in the belt diameter direction.

Further, an end portion 52*c* of the IH coil unit 52 is an end portion in the belt circumferential direction of each of the first core 57 and the second core 58, and includes a portion protruding to the inner side in the belt diameter direction.

The second coil 84*a* is arranged in an area S1 (refer to FIG. 2) which faces the auxiliary heating plate 69 but does not face the main coil 56. Specifically, the area S1 is positioned between the end portion 52*c* of the IH coil unit 52 and the fixing belt 50 in the belt diameter direction. The area S1 ranges from the outer side of the main coil 56 to the end portion 69*c* of the auxiliary heating plate 69 in the belt circumferential direction. The area S1 faces not only the end portion 52*c* of the IH coil unit 52 but also the end portion 69*c* of the auxiliary heating plate 69 across the fixing belt 50 in the belt circumferential direction. One end (end at the inner side) of the area S1 in the belt circumferential direction faces a boundary between the end portion 52*c* of the IH coil unit 52 and the main coil 56 in the belt diameter direction. The other end (an end at the outer side) of the area S1 in the belt width direction faces front ends (arc-shaped both ends) of the end portion 69*c* of the auxiliary heating plate 69 across the fixing belt 50 in the belt diameter direction.

In the present embodiment, the second coil 84*a* is arranged at the outer peripheral side of the fixing belt 50. The second coil 84*a* faces the end portion 69*c* of the auxiliary heating plate 69 across the fixing belt 50.

Further, the second coil 84*a* may face the facing area 69*a* of the auxiliary heating plate 69 across the fixing belt 50 in a range where the second coil 84*a* does not face the main coil 56.

The second coil 84*a* is fixed separately from the fixing belt 50 at a given interval. The second coil 84*a* at least faces the paper passing area in the belt width direction. For example, the second coil 84*a* faces a central portion of the fixing belt 50.

The size of the second coil 84*a* is smaller than that of the main coil 56, because the second coil 84*a* is used to generate a magnetic field passing through the auxiliary heating plate 69 that is sufficient for the electric resistance measurement circuit 84*b* to measure the electric resistance of the second coil 84*a*.

When compared to a case in which the size of the second coil 84*a* is identical to or larger than the size of the main coil 56, it is possible to arrange the second coil 84*a* in the area S1 easier.

The magnetic flux generated by the second coil 84*a* forms a third magnetic path 85 that extends through the heating layer 50*a* of the fixing belt 50. Further, the magnetic flux generated by the second coil 84*a* forms a fourth magnetic path 86 that extends through the auxiliary heating plate 69 before auxiliary heating plate 69 loses its magnetism due to the temperature thereof exceeding the Curie point thereof. The fourth magnetic path 86 is formed at a position adjacent to the third magnetic path 85 in the belt diameter direction. The fourth magnetic path 86 passes through the auxiliary heating plate 69 and the heating layer 50*a*. The electric resistance of the second coil 84*a* varies in accordance with change of the magnetism of the auxiliary heating plate 69. That is, the electric resistance of the second coil 84*a* varies according to whether or not the fourth magnetic path 86 is formed.

A weak high frequency current (hereinafter referred to as a "high frequency weak current") flows into the second coil 84*a*, and this current enables the electric resistance measurement circuit 84*b* to measure the electric resistance of the second coil 84*a*. For example, the electric resistance measurement circuit 84*b* is connected at an upstream side and a downstream side of the second coil 84*a* in a current flowing direction, and the aforementioned electric resistance is measured according to the values of current respectively at the upstream side and the downstream side of the second coil 84*a*. Further, it is assumed that the high frequency weak current is weaker than the high frequency current output from the inverter driving circuit 68.

Next, an example of an operation of the fixing apparatus 34 according to the first embodiment is described with reference to FIG. 7.

Figure 7:
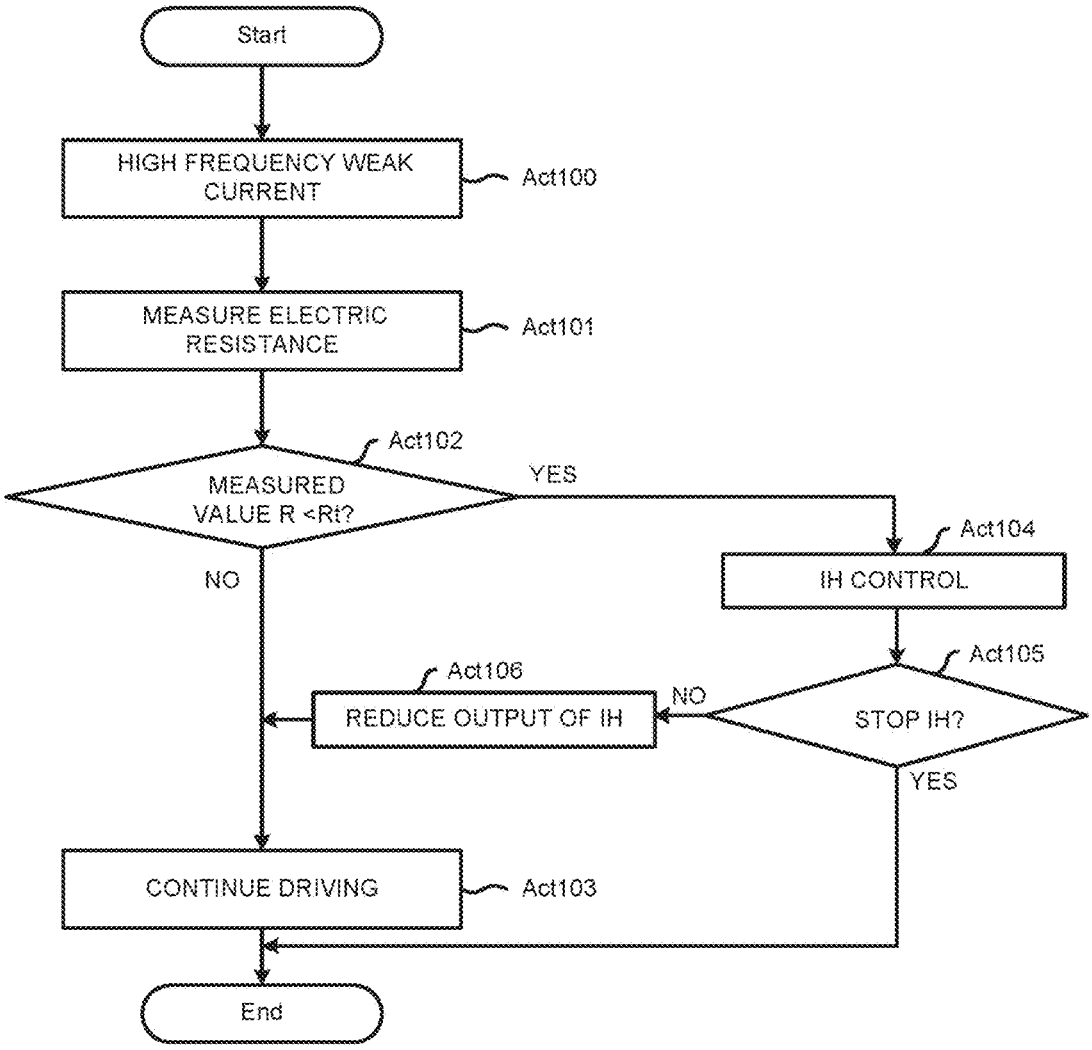
FIG. 7 is a flowchart illustrating an operation carried out by the fixing apparatus according to the first embodiment.

FIG. 7 is a flowchart illustrating an operation of the fixing apparatus 34 according to the first embodiment.

In ACT 100, the electric resistance measurement circuit 84*b* causes the high frequency weak current to flow into the second coil 84*a*. It is assumed that, for example, the frequency and current of the high frequency weak current are respectively 60 kHz and 10 mA.

In ACT 101, the electric resistance measurement circuit 84*b* measures the electric resistance of the second coil 84*a*. It is assumed in the present embodiment that the electric resistance of the second coil 84*a* measured by the electric resistance measurement circuit 84*b* is a "measured value R". The main control circuit 101 acquires the measured value R from the electric resistance measurement circuit 84*b*.

Alternatively, the main control circuit 101 may acquire the measured value R from other circuit such as a logic circuit.

In ACT 102, the main control circuit 101 determines whether or not the measured value R acquired in ACT 101 is smaller than a threshold value Rt (for example, 1"Ω").

By determining whether or not the measured value R is smaller than the threshold value Rt, it is possible to determine the change of magnetism of the auxiliary heating plate 69 for the following reasons.

When the measured value R is greater than the threshold value Rt, the auxiliary heating plate 69 has ferromagnetism because its temperature is lower than the Curie point thereof. When the auxiliary heating plate 69 has ferromagnetism, the magnetic flux generated by the second coil 84*a* forms the third magnetic path 85 and the fourth magnetic path 86.

On the other hand, when the measured value R is smaller than the threshold value Rt, the auxiliary heating plate 69 has paramagnetism because its temperature is higher than the Curie point thereof. In such a case, the fourth magnetic path 86 is not formed.

Thus, it is possible to estimate the magnetism of the auxiliary heating plate 69 by determining whether or not the measured value R is smaller than the threshold value Rt.

When the main control circuit 101 determines that the measured value R is smaller than the threshold value Rt (YES in ACT 102), the process proceeds to ACT 104. When the main control circuit 101 determines that the measured value R is greater than the threshold value Rt (NO in ACT 102), the process proceeds to ACT 103.

In ACT 103, the fixing apparatus 34 continues its driving. For example, when performing a high output driving such as a continuous paper passing and the warming up, the fixing apparatus 34 continues the high output driving.

In ACT 104, the main control circuit 101 controls the IH coil unit 52 based on the measured value R.

In ACT 105, the main control circuit 101 determines whether to stop the IH coil unit 52, based on the measured value R. For example, when the measured value R is smaller than 0.5"Ω", the main control circuit 101 determines to stop the IH coil unit 52. If it is determined to stop the IH coil unit 52 (YES in ACT 105), the main control circuit 101 terminates the processing. By stopping the IH coil unit 52, the main control circuit 101 suppresses the excessive temperature rise of the IGBT element 68*a*. Consequently, the main control circuit 101 prevents the IGBT element 68*a* from being damaged.

If it is determined not to stop the IH coil unit 52 (NO in ACT 105), the process proceed to ACT 106.

In ACT 106, the main control circuit 101 reduces the output of the IH coil unit 52. For example, the main control circuit 101 reduces the power supplied to the IH coil unit 52. By reducing the output of the IH coil unit 52, the main control circuit 101 suppresses the excessive temperature rise of the IGBT element 68*a*. Consequently, the main control circuit 101 prevents the IGBT element 68*a* from being damaged.

In ACT 103, the fixing apparatus 34 continues its driving when the output of the IH coil unit 52 is reduced.

Hereinafter, the operation of the fixing apparatus 34 during a warming-up operation is described.

As shown in FIG. 2, the fixing apparatus 34 rotates the fixing belt 50 in the direction indicated by the arrow u during the warming-up operation. By applying the high frequency current through the inverter driving circuit 68, the IH coil unit 52 generates magnetic flux at the side of the fixing belt 50.

For example, the fixing belt 50 is rotated in the direction indicated by the arrow u when the fixing belt 50 is separated from the press roller 51 during the warming-up operation. Compared to a case of rotating the fixing belt 50 when the fixing belt 50 is in contact with the press roller 51, it is possible to avoid the heat of the fixing belt 50 from transferring to the press roller 51. Consequently, it is possible to shorten the period of the warming up operation.

Alternatively, the fixing belt 50 may be driven to rotate in the direction indicated by the arrow u by rotating the press roller 51 in the direction indicated by the arrow q when the press roller 51 is in contact with the fixing belt 50 at the time of warming up.

As shown in FIG. 4, the IH coil unit 52 heats the fixing belt 50 through the first magnetic path 81. The auxiliary heating plate 69 assists the IH coil unit 52 in heating the fixing belt 50 through the second magnetic path 82. In this way, it enables the rapid warming up of the fixing belt 50.

As shown in FIG. 2, the IH control circuit 67 controls the inverter driving circuit 68 according to the measured results of the belt temperatures measured by the center thermistor 61 and the edge thermistor 62. The inverter driving circuit 68 supplies the high frequency current to the main coil 56.

Hereinafter, the operations of the fixing apparatus 34 during a fixing operation are described.

After the fixing belt 50 reaches the fixing temperature and the warming-up operation is ended, the press roller 51 is moved to be in contact with the fixing belt 50. In a state in which the press roller 51 is in contact with the fixing belt 50, the fixing belt 50 may be driven to rotate in the direction indicated by the arrow u by rotating the press roller 51 in the direction indicated by the arrow q. When a print request is received, the MFP 10 (refer to FIG. 1) starts a print operation in response. The MFP 10 forms a toner image on the sheet P with the printer unit 18, and conveys the sheet P to the fixing apparatus 34.

The MFP 10 causes the sheet P on which the toner image is formed to pass through the nip 54 between the fixing belt 50 that reaches the fixing temperature and the press roller 51. The fixing apparatus 34 fixes the toner image on the sheet P. During the fixing operation, the IH control circuit 67 controls the IH coil unit 52 to keep the fixing temperature of the fixing belt 50 constant.

Through the fixing operation, the heat of the fixing belt 50 transfers to the sheet P. For example, when a plurality of sheets P continuously passes at a high speed, since the amount of heat transferring to the sheets P is large, the fixing belt 50 having low heat capacity may not be maintained at the fixing temperature. The heat caused by the second magnetic path 82 supplements heating of the fixing belt 50. As a result, the belt temperature can be maintained at the fixing temperature even in the continuous paper passing at a high speed.

Here, disposing a thermistor which measures the temperature of the IGBT element 68*a* would be useful to prevent the IGBT element 68*a* from being damaged. In such a case, the thermistor would be installed in a case of the inverter driving circuit 68 but not in the IGBT element 68*a* itself. When the thermistor measures a temperature rise of the IGBT element 68*a*, the main control circuit 101 would drive a fan to cool the IGBT element 68*a*. Through the thermistor, the gentle temperature rise of the IGBT element 68*a* may be measured. However, it is difficult for the thermistor to measure a sudden temperature rise. Further, as the thermistor is installed in the case, it is difficult for the thermistor to measure the accurate temperature of the IGBT element 68*a*. The measured temperature of the IGBT element 68*a* by the thermistor may be divergent from the actual temperature of the IGBT element 68*a*. Moreover, the cooling of the IGBT element 68*a* by the fan may not sufficiently cool the internal portion of the IGBT element 68*a*. Thus, the damage of the IGBT element 68*a* cannot be sufficiently prevented by the temperature measurement of the thermistor and the cooling process by the fan.

To the contrary, according to the first embodiment, the electric resistance measurement circuit 84*b* measures the electric resistance of the second coil 84*a*. By measuring the electric resistance of the second coil 84*a*, it is possible to measure not only the gentle temperature rise but also the sudden temperature rise of the IGBT element 68*a* indirectly. Compared with the case of arranging the thermistor described above, it is possible to measure the temperature of the IGBT element 68*a* in real time by measuring the electric resistance of the second coil 84*a*. Furthermore, difference between the measured temperature and the actual temperature of the IGBT element 68*a* would not be an issue in the present embodiment.

Further, the main control circuit 101 acquires the electric resistance (measured value R) of the second coil 84*a* from the electric resistance measurement circuit 84*b*. The main control circuit 101 controls the IH coil unit 52 to weaken the electromagnetic induction heating when the measured value R is smaller than a threshold value. By weakening the electromagnetic induction heating when the measured value R is smaller than the threshold value, it is possible to suppress the excessive temperature rise of the IGBT element 68*a*. Specifically, the main control circuit 101 determines whether or not the measured value R is smaller than the threshold value Rt. If it is determined that the measured value R is smaller than the threshold value Rt, the main control circuit 101 reduces heat generation caused by the IH coil unit 52. For example, it is possible to suppress the excessive temperature rise of the IGBT element 68*a* by stopping the IH coil unit 52 or by reducing the heat generation by the IH coil unit 52. As a result, it is possible to prevent the IGBT element 68*a* from being damaged.

Further, as the second coil 84*a* is arranged separately from the main coil 56, the electric resistance measurement circuit 84*b* can measure the electric resistance of the second coil 84*a*. Thus, the main control circuit 101 can acquire the measured value R.

The second coil 84*a* is arranged in the area S1 which faces the auxiliary heating plate 69 but does not face the main coil 56. Compared to a second coil located in an area facing the main coil 56, it is possible to measure the electric resistance of the second coil 84*a* accurately because the second coil 84*a* is less likely to be affected by a large magnetic force of the main coil 56.

The second coil 84*a* is arranged to face the end portion 69*c* (a portion adjacent to the facing area 69*a*) of the auxiliary heating plate 69 across the fixing belt 50. According to this arrangement, the second coil unit 84 can measure the electric resistance of the second coil 84*a* at a location having a temperature change identical to that of the facing area 69*a* (a location having a correlation with the temperature change of the facing area 69*a*).

Further, the second coil 84*a* is arranged to face at least the paper passing area in the belt width direction. According to this arrangement, the second coil unit 84 can measure the electric resistance of the second coil 84*a* separately from the non-paper passing area. Thus, the main control circuit 101 can acquire the measured value R separately from the non-paper passing area.

Second Embodiment

Next, a second embodiment is described with reference to FIG. 8. Here, components identical to those in the first embodiment are described with the same reference numerals and the description thereof is not provided.

Figure 8:
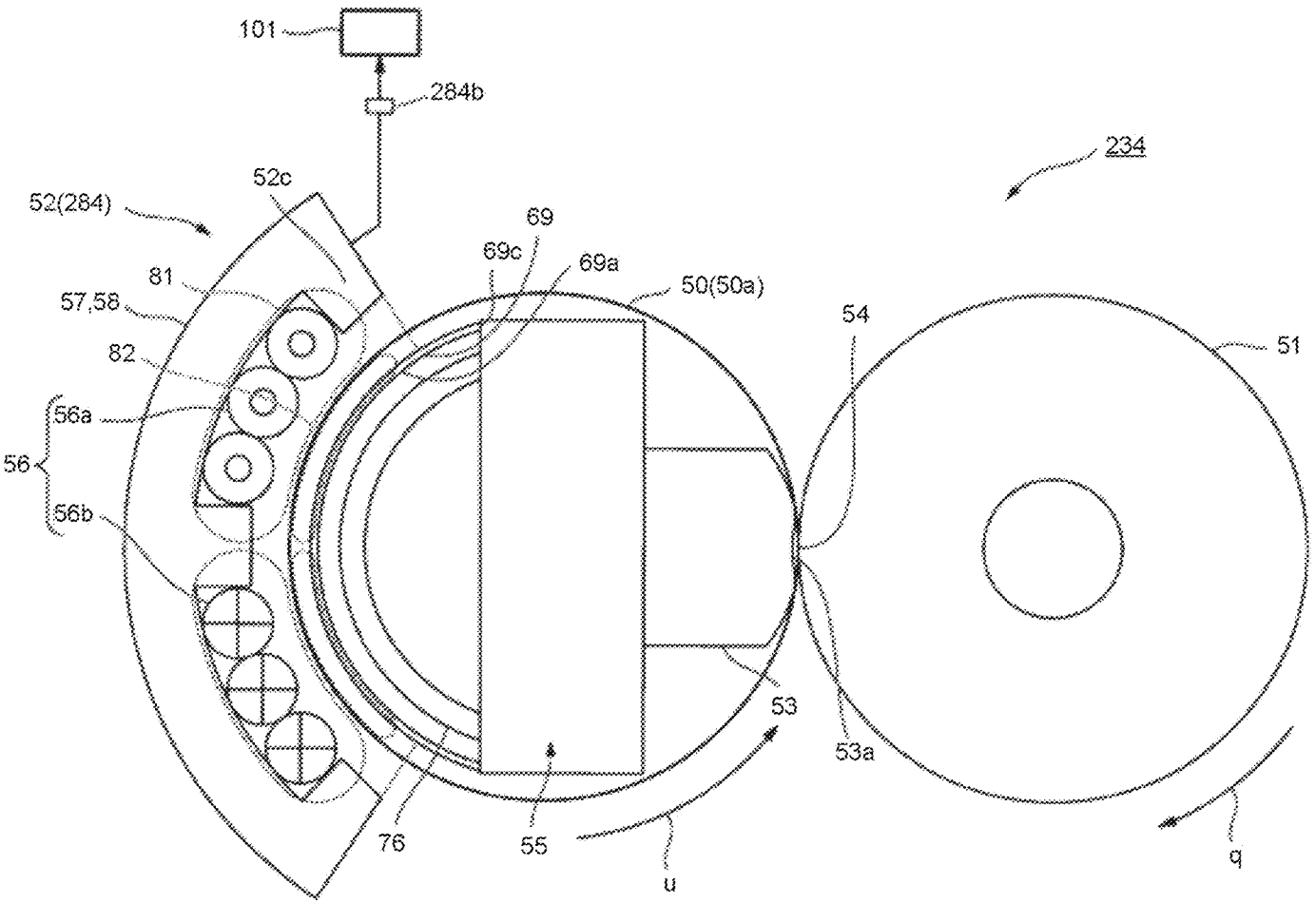
FIG. 8 is a side view of a fixing apparatus according to a second embodiment.

FIG. 8 is a side view of a fixing apparatus 234 according to the second embodiment. Further, FIG. 8 corresponds to the side view of FIG. 6.

As shown in FIG. 8, the fixing apparatus 234 according to the second embodiment does not include the second coil 84*a* of the first embodiment. The fixing apparatus 234 according to the second embodiment is different from the first embodiment in that it includes a measurement unit 284 using the main coil 56. Further, a reference numeral 284*b* indicates the electric resistance measurement circuit in FIG. 8.

The IH coil unit 52 includes the main coil 56 (coil) which heats the heating layer 50*a* through an electromagnetic induction. The IH coil unit 52 also functions as the measurement unit 284. The measurement unit 284 generates a magnetic field passing through the auxiliary heating plate 69 through the energization to the main coil 56. The measurement unit 284 measures the electric resistance of the main coil 56.

The magnetic flux generated by the main coil 56 forms the first magnetic path 81 and the second magnetic path 82. The electric resistance of the main coil 56 varies in accordance with the change of magnetism of the auxiliary heating plate 69.

As the high frequency weak current flows into the main coil 56, the electric resistance of the main coil 56 can be measured.

The electric resistance measurement circuit 284*b* measures the electric resistance of the main coil 56. It is assumed in the present embodiment that the electric resistance of the main coil 56 measured by the electric resistance measurement circuit 284*b* is "the measured value R". The main control circuit 101 acquires the measured value R from the electric resistance measurement circuit 284*b*.

The main control circuit 101 determines whether or not the measured value R acquired is smaller than the threshold value Rt (for example, 1"Ω").

By determining whether or not the measured value R is smaller than the threshold value Rt, it is possible to determine the change of magnetism of the auxiliary heating plate 69 for the following reasons.

When the measured value R is greater than the threshold value Rt, the auxiliary heating plate 69 has ferromagnetism because its temperature is lower than the Curie point thereof. When the auxiliary heating plate 69 has ferromagnetism, the magnetic flux generated by the main coil 56 forms the first magnetic path 81 and the second magnetic path 82.

On the other hand, when the measured value R is smaller than the threshold value Rt, the auxiliary heating plate 69 has paramagnetism because its temperature is higher than the Curie point thereof. In such a case, the second magnetic path 82 is not formed.

Thus, by determining whether or not the measured value R is smaller than the threshold value Rt, it is possible to estimate the magnetism of the auxiliary heating plate 69.

The main control circuit 101 controls the IH coil unit 52 to reduce the heat generation through the electromagnetic induction heating when the acquired measured value R is smaller than the threshold value Rt.

In accordance with the second embodiment, the same effects as the first embodiment can be obtained.

Further, compared with the case in which the second coil 84*a* faces the end portion 69*c* of the auxiliary heating plate 69 across the fixing belt 50, it is possible to measure the electric resistance of the main coil 56 at a location facing the facing area 69*a*. Consequently, it is possible to determine the change of magnetism of the facing area 69*a*.

Further, it is possible to measure the electric resistance of the main coil 56 at the timing when the IH coil unit 52 does not generate heat. For example, it is possible to measure the electric resistance of the main coil 56 at a timing between print operations, except for during the continuous paper passing and the warming up (for example, when every 10 papers pass). As a result, the change of magnetism of the facing area 69*a* can be determined between print jobs.

Compared with the case in which the second coil 84*a* is arranged separately from the main coil 56, the number of components can be reduced and thereby the configuration of the fixing apparatus 234 can be simplified.

Further, the electric resistance of the main coil 56 may be measured at the timing when the IH coil unit 52 generates heat. For example, the electric resistance of the main coil 56 is measured during the continuous paper passing and the warming up. In this way, it is possible to measure the electric resistance of the main coil 56 at the location facing the facing area 69*a* in real time. Consequently, during the continuous paper passing and the warming up, it is possible to determine the change of magnetism of the facing area 69*a* in real time.

Third Embodiment

Next, a third embodiment is described with reference to FIG. 9. Here, components identical to those in the first embodiment are described with the same reference numerals and the description thereof is not provided.

Figure 9:
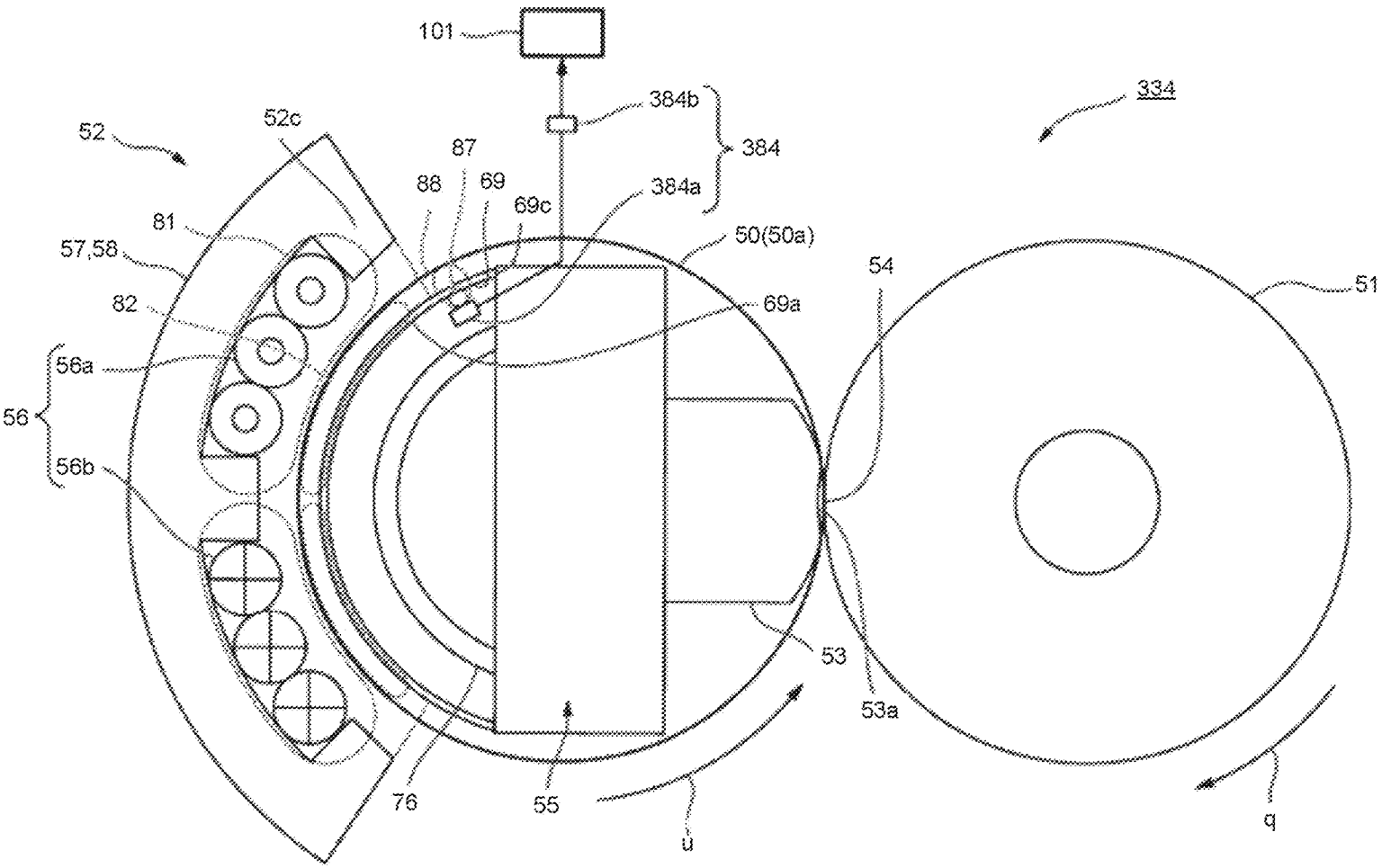
FIG. 9 is a side view of a fixing apparatus according to a third embodiment.

FIG. 9 is a side view of a fixing apparatus 334 according to the third embodiment. Further, FIG. 9 corresponds to the side view of FIG. 6.

As shown in FIG. 9, the fixing apparatus 334 according to the third embodiment does not include the second coil 84*a* of the first embodiment. The fixing apparatus 334 according to the third embodiment is different from the first embodiment in that it includes a second coil 384*a* arranged at the inner peripheral side of the fixing belt 50. The second coil 384*a* is arranged at the inner side in the diameter direction of the auxiliary heating plate 69. Further, a reference numeral 384 indicates the second coil unit and a reference numeral 384*b* indicates the electric resistance measurement circuit in FIG. 9.

The magnetic flux generated by the second coil 384*a* forms a fifth magnetic path 87 that extends through the auxiliary heating plate 69 before the auxiliary heating plate 69 loses its magnetism due to the temperature thereof exceeding the Curie point thereof. The fifth magnetic path 87 passes through the auxiliary heating plate 69 in such a manner that it does not extend to the outer side of the auxiliary heating plate 69 in the belt diameter direction.

The magnetic flux generated by the second coil 384*a* forms a sixth magnetic path 88 that extends through the heating layer 50*a* of the fixing belt 50 when the auxiliary heating plate loses its magnetism due to the temperature thereof exceeding the Curie point thereof. The sixth magnetic path 88 extends to the outer side of the auxiliary heating plate 69 in the belt diameter direction, passing through the heating layer 50*a*. The electric resistance of the second coil 384*a* varies in accordance with the change of magnetism of the auxiliary heating plate 69.

By causing a high frequency weak current in the second coil 384*a*, it is possible to measure the electric resistance of the second coil 384*a*. The electric resistance measurement circuit 384*b* measures the electric resistance of the second coil 384*a*. It is assumed in the present embodiment that the electric resistance of the second coil 384*a* measured by the electric resistance measurement circuit 384*b* is a "measured value R". The main control circuit 101 acquires the measured value R from the electric resistance measurement circuit 384*b*.

The main control circuit 101 determines whether or not the acquired measured value R is smaller than the threshold value Rt (for example, 1 "Q").

By determining whether or not the measured value R is smaller than the threshold value Rt, it is possible to determine the magnetism of the auxiliary heating plate 69 for the following reasons.

When the measured value R is greater than the threshold value Rt, the auxiliary heating plate 69 has ferromagnetism because its temperature is lower than the Curie point thereof. When the auxiliary heating plate 69 exhibits ferromagnetism, the magnetic flux generated by the second coil 384*a* forms the fifth magnetic path 87.

On the other hand, when the measured value R is smaller than the threshold value Rt, the auxiliary heating plate 69 has paramagnetism because its temperature is higher than the Curie point thereof. In such a case, the magnetic flux generated by the second coil 384*a* forms the sixth magnetic path 88, but the fifth magnetic path 87 is not formed.

It is possible to estimate the magnetism of the auxiliary heating plate 69 by determining whether or not the measured value R is smaller than the threshold value Rt.

The main control circuit 101 controls the IH coil unit 52 to reduce the heat generation through the electromagnetic induction heating when the acquired measured value R is smaller than the threshold value Rt.

In accordance with the third embodiment, the same effects as the first embodiment can be obtained.

Further, in the present embodiment, the second coil 384*a* is arranged at the inner side in the belt diameter direction of the auxiliary heating plate 69 on the inner peripheral side of the fixing belt 50. Compared with a second coil disposed on the outer peripheral side of the fixing belt 50, it is possible to aggregate the second coil 384*a* as well as the auxiliary heating plate 69 on the inner peripheral side of the fixing belt 50.

In accordance with the fixing apparatus of at least one embodiment described above, the excessive temperature rise of the IGBT element 68*a* can be suppressed, which can prevent the IGBT element 68*a* from being damaged.

Further, the heating layer 50*a* may be made from the magnetic material such as nickel.

Furthermore, the measurement unit described above is not limited to the electric resistance measurement unit described above. For example, the measurement unit may include a temperature measurement unit which measures the temperature of the auxiliary heating plate 69. For example, the temperature measurement unit is a temperature sensor. By measuring the temperature of the auxiliary heating plate 69, it is possible to determine whether or not the temperature of the auxiliary heating plate 69 exceeds the curie point directly. That is, as long as the measurement unit can measure the state of the auxiliary heating plate 69, no limitation is given to the configuration of the measurement unit.

Further, the present invention is not limited to that the main control circuit 101 indirectly determines whether or not the temperature of the auxiliary heating plate 69 exceeds the Curie point based on the measured results by the electric resistance measurement circuit. For example, the main control circuit 101 may determine whether or not the temperature of the auxiliary heating plate 69 exceeds the Curie point directly based on the measured results by the temperature sensor. That is, as long as the main control circuit 101 can control to reduce the heat generation by the IH coil unit when it is determined that the temperature of the auxiliary heating plate 69 exceeds the Curie point based on the measured results by the measurement unit, no limitation is given to the determination method.

The functions of the fixing apparatuses in the embodiments described above may be realized by a computer. In that case, programs for achieving the functions may be recorded in a computer-readable recording medium, and the programs recorded in the recording medium may be read by a computer system and executed to realize the functions. Further, it is assumed that the "computer system" includes hardware such as an OS, a peripheral machine and the like. Further, the "readable recording medium" refers to a movable medium such as a flexible disc, a magnetic optical disc, an ROM, a CD-ROM and the like, and a storage device such as a hard disk arranged inside the computer system. Further, the "computer-readable recording medium" may store programs dynamically for a short time like a communication line in a case of sending the programs via a network such as the Internet, a telecommunication line such as telephone line and the like, and may also store programs for a certain time like a volatile memory inside a computer system consisting of a server and a client in that case. Further, the programs may be used to realize part of the aforementioned functions, or may also be used to realize the aforementioned functions through a combination with the programs that have already stored in the computer system.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing apparatus, comprising:

a belt including a ferromagnetic layer;

a ferromagnetic plate disposed inside the belt and having a Curie point that is lower than a Curie point of the ferromagnetic layer;

an induction heater configured to cause heat generation in the ferromagnetic layer and the ferromagnetic plate, the induction heater including a first coil;

a driving circuit configured to output a high frequency current to the first coil, and to change the high frequency current;

a measurement unit configured to output a signal indicative of whether a temperature of the ferromagnetic plate exceeds a predetermined value, the measurement unit including:

a second coil positioned proximate to the ferromagnetic plate, and an electrical resistance measurement circuit configured to measure an electrical resistance of the second coil, the electrical resistance of the second coil decreasing as the temperature of the second coil increases; and a controller configured to:

receive the signal output from the measurement unit, determine whether the temperature of the ferromagnetic plate exceeds the predetermined value based on the signal, and control the driving circuit to decrease the high frequency current if the temperature of the first coil exceeds the predetermined value.

2. The fixing apparatus according to claim 1, wherein the predetermined value is the Curie point of the ferromagnetic plate.

3. The fixing apparatus according to claim 1, wherein the first coil is at a position corresponding to a sheet passing region of the belt in a width direction of the belt.

4. The fixing apparatus according to claim 1, wherein the driving circuit comprises switching elements including an insulated gate bipolar transistor (IGBT) and a metal oxide semiconductor field effect transistor (MOSFET), and the controller decreases the high frequency current by extending an on period of the MOSFET.

5. The fixing apparatus according to claim 1, wherein the measurement unit is a temperature sensor.

6. A fixing apparatus, comprising:

a belt including a ferromagnetic layer;

a ferromagnetic plate disposed inside the belt and having a Curie point that is lower than a Curie point of the ferromagnetic layer;

an induction heater configured to cause heat generation in the ferromagnetic layer and the ferromagnetic plate, the induction heater including a first coil;

a driving circuit configured to output a high frequency current to the first coil, and to change the high frequency current by switching on and off switching elements;

a measurement unit configured to output a signal indicative of whether a temperature of the ferromagnetic plate exceeds a predetermined value, the measurement unit including:

a second coil positioned proximate to the ferromagnetic plate, and an electrical resistance measurement circuit configured to measure an electrical resistance of the second coil, the electrical resistance of the second coil decreasing as the temperature of the second coil increases; and a controller configured to:

receive the signal output from the measurement unit, determine whether the temperature of the ferromagnetic plate exceeds the predetermined value based on the signal, and control the driving circuit to decrease the high frequency current if the temperature of the first coil exceeds the predetermined value.

7. The fixing apparatus according to claim 6, wherein the predetermined value is the Curie point of the ferromagnetic plate.

8. The fixing apparatus according to claim 6, wherein the first coil is at a position corresponding to a sheet passing region of the belt in a width direction of the belt.

9. The fixing apparatus according to claim 6, wherein the driving circuit comprises switching elements including an insulated gate bipolar transistor (IGBT) and a metal oxide semiconductor field effect transistor (MOSFET), and the controller decreases the high frequency current by extending an on period of the MOSFET.

10. The fixing apparatus according to claim 6, wherein the measurement unit is a temperature sensor.

* * * * *